US010490091B1

(12) United States Patent
Lenhardt et al.

(10) Patent No.: US 10,490,091 B1
(45) Date of Patent: Nov. 26, 2019

(54) SYSTEMS AND METHODS FOR AVOIDANCE TRAVERSAL ANALYSIS FOR FLIGHT-PLAN ROUTING

(71) Applicant: Rockwell Collins, Inc., Cedar Rapids, IA (US)

(72) Inventors: Paul A. Lenhardt, Cedar Rapids, IA (US); Jason J. Jakusz, Cedar Rapids, IA (US); Johnathon Lloyd Hein, Cedar Rapids, IA (US)

(73) Assignee: ROCKWELL COLLINS, INC., Cedar Rapids, IA (US)

( * ) Notice: Subject to any disclaimer, the term of this patent is extended or adjusted under 35 U.S.C. 154(b) by 0 days.

(21) Appl. No.: 16/138,807

(22) Filed: Sep. 21, 2018

(51) Int. Cl.
*G08G 5/04* (2006.01)
*G08G 5/00* (2006.01)

(52) U.S. Cl.
CPC ..... *G08G 5/045* (2013.01); *G08G 5/0034* (2013.01)

(58) Field of Classification Search
CPC ..... G08G 5/045; G08G 5/0034
USPC ..... 340/961
See application file for complete search history.

(56) References Cited

U.S. PATENT DOCUMENTS 6,744,382 B1 * 6/2004 Lapis ..... G01C 23/005 340/963
8,843,303 B1 * 9/2014 Young ..... G08G 5/0039 701/122
9,132,913 B1 * 9/2015 Shapiro ..... B64C 19/00
9,499,278 B1 * 11/2016 Finley ..... B64D 45/00
9,558,670 B1 * 1/2017 Sheth ..... G08G 5/0013
9,587,952 B1 * 3/2017 Slusar ..... G06Q 10/00
9,754,495 B2 * 9/2017 Whelan ..... G08G 5/0021
2015/0371544 A1 * 12/2015 Mere ..... G08G 5/0039 701/3
2016/0140851 A1 * 5/2016 Levy ..... G08G 5/0069 701/3
2016/0253908 A1 * 9/2016 Chambers ..... B64C 39/024 701/2
2017/0076617 A1 * 3/2017 Schupp ..... G08G 5/045
2018/0144643 A1 * 5/2018 Moravek ..... G08G 5/0021
2018/0268725 A1 * 9/2018 Gadgil ..... G08G 5/0078
2018/0275655 A1 * 9/2018 Raynaud ..... G01C 23/00
2018/0366008 A1 * 12/2018 Dacre-Wright ..... G08G 5/0021
(Continued)

*Primary Examiner* — Hirdepal Singh
(74) *Attorney, Agent, or Firm* — Donna P. Suchy; Daniel M. Barbieri

(57) ABSTRACT

A system for an airborne platform includes a display device and a processing circuit. The processing circuit is configured to receive avoidance configuration information having a plurality of avoidance categories and severity levels. The processing circuit is further configured to receive flight plan information relating to a flight route from a starting location to an ending location, an avoidance area, an indication of an avoidance category corresponding to the avoidance area, and an indication of a severity level. The processing circuit is further configured to calculate a normalized cost associated with the flight route and compare the normalized cost to a threshold value. The processing circuit is further configured to identify the avoidance area as non-traversable when the normalized cost exceeds the threshold value. The processing circuit is further configured to generate a display providing a visual representation of the normalized cost, the flight route, and the avoidance area.

20 Claims, 6 Drawing Sheets

(56) References Cited

U.S. PATENT DOCUMENTS

| | | | | |
|---|---|---|---|---|
| 2019/0033862 | A1* | 1/2019 | Groden | G05D 1/0072 |
| 2019/0122570 | A1* | 4/2019 | Flotte | G08G 5/045 |

* cited by examiner

Aircraft - 210
UI Elements - 104
Communication System - 204
Aircraft Sensors - 206
Processing Circuit - 202
Flight Displays - 102
Flight Monitoring System - 208
200

SYSTEMS AND METHODS FOR AVOIDANCE TRAVERSAL ANALYSIS FOR FLIGHT-PLAN ROUTING

BACKGROUND

The inventive concepts disclosed herein relate generally to the field of navigation systems. More particularly, embodiments of the inventive concepts disclosed herein relate to systems and methods for avoidance traversal with cost-based flight plan routing.

An aircraft navigation system may determine a flight path between two geographic locations to minimize travel distance, travel time, fuel usage, etc. The flight path may involve an avoidance, which may relate to turbulence, inclement weather, flight restrictions, and other events the aircraft operator may wish to avoid. An avoidance may be associated with one or more severity levels. For example, an avoidance associated with turbulence may have a severity level associated with each of light turbulence, moderate turbulence, and severe turbulence. It may be desirable to travel a distance through an avoidance depending on, for example, the type of avoidance and/or a severity level associated with the avoidance.

A navigation system may classify an avoidance area as traversable or non-traversable. This classification creates a binary representation of a continuous range of avoidances with varying severities. An aircraft operator will decide whether an avoidance will be avoided or disregarded. The aircraft operator may configure the navigation system to generate a flight path accordingly.

SUMMARY

In one aspect, the inventive concepts disclosed herein are directed to a method. The method includes receiving, by a processing circuit, avoidance configuration information, the avoidance configuration information having a plurality of avoidance categories, each of the avoidance categories having a number of severity levels, each of the severity levels associated with a multiplier value selected from a set of multiplier values. The method further includes receiving, by the processing circuit, flight plan information relating to a flight route from a starting location to an ending location, an avoidance area, an indication of an avoidance category corresponding to the avoidance area, and an indication of a severity level corresponding to the avoidance area, wherein the flight route includes at least one avoidance-traversing segment, the avoidance-traversing segment corresponding to a portion of the flight route within the avoidance area. The method further includes calculating, by the processing circuit, a normalized cost associated with the flight route, the normalized cost based on a distance of the avoidance-traversing segment and on a multiplier value associated with the severity level corresponding to the avoidance area. The method further includes comparing, by the processing circuit, the normalized cost route to a threshold value. The method further includes identifying, by the processing circuit, the avoidance area as non-traversable when the normalized cost associated with the flight route exceeds the threshold value. The method further includes generating, by the processing circuit, a display providing a visual representation of at least one of the normalized cost, the flight route, and the avoidance area.

In a further aspect, the inventive concepts disclosed herein are directed to a processing circuit having a processor and a memory. The processing circuit is configured to receive avoidance configuration information, the avoidance configuration information having a plurality of avoidance categories, each of the avoidance categories having a number of severity levels, each of the severity levels associated with a multiplier value selected from a set of multiplier values. The processing circuit is further configured receive flight plan information, flight plan information relating to a flight route from a starting location to an ending location, an avoidance area, an indication of an avoidance category corresponding to the avoidance area, and an indication of a severity level corresponding to the avoidance area, wherein the flight route includes at least one avoidance-traversing segment, the avoidance-traversing segment corresponding to a portion of the flight route within the avoidance area. The processing circuit is further configured to calculate a normalized cost associated with the flight route, the normalized cost based on a distance of the avoidance-traversing segment and on a multiplier value associated with the severity level corresponding to the avoidance area. The processing circuit is further configured to compare the normalized cost associated with the flight route to a threshold value. The processing circuit is further configured to identify the avoidance area as non-traversable when the normalized cost associated with the flight route exceeds the threshold value. The processing circuit is further configured to generate a display providing a visual representation of at least one of the normalized cost, the flight route, and the avoidance area.

In a further aspect, the inventive concepts disclosed herein are directed to a system for an airborne platform. The system includes a display device and a processing circuit communicably coupled to the display device. The display device is configured to provide a display. The processing circuit is configured to receive avoidance configuration information, the avoidance configuration information having a plurality of avoidance categories, each of the avoidance categories having a number of severity levels, each of the severity levels associated with a multiplier value selected from a set of multiplier values. The processing circuit is further configured receive flight plan information, flight plan information relating to a flight route from a starting location to an ending location, an avoidance area, an indication of an avoidance category corresponding to the avoidance area, and an indication of a severity level corresponding to the avoidance area, wherein the flight route includes at least one avoidance-traversing segment, the avoidance-traversing segment corresponding to a portion of the flight route within the avoidance area. The processing circuit is further configured to calculate a normalized cost associated with the flight route, the normalized cost based on a distance of the avoidance-traversing segment and on a multiplier value associated with the severity level corresponding to the avoidance area. The processing circuit is further configured to compare the normalized cost associated with the flight route to a threshold value. The processing circuit is further configured to identify the avoidance area as non-traversable when the normalized cost associated with the flight route exceeds the threshold value. The processing circuit is further configured to generate a display providing a visual representation of at least one of the normalized cost, the flight route, and the avoidance area.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
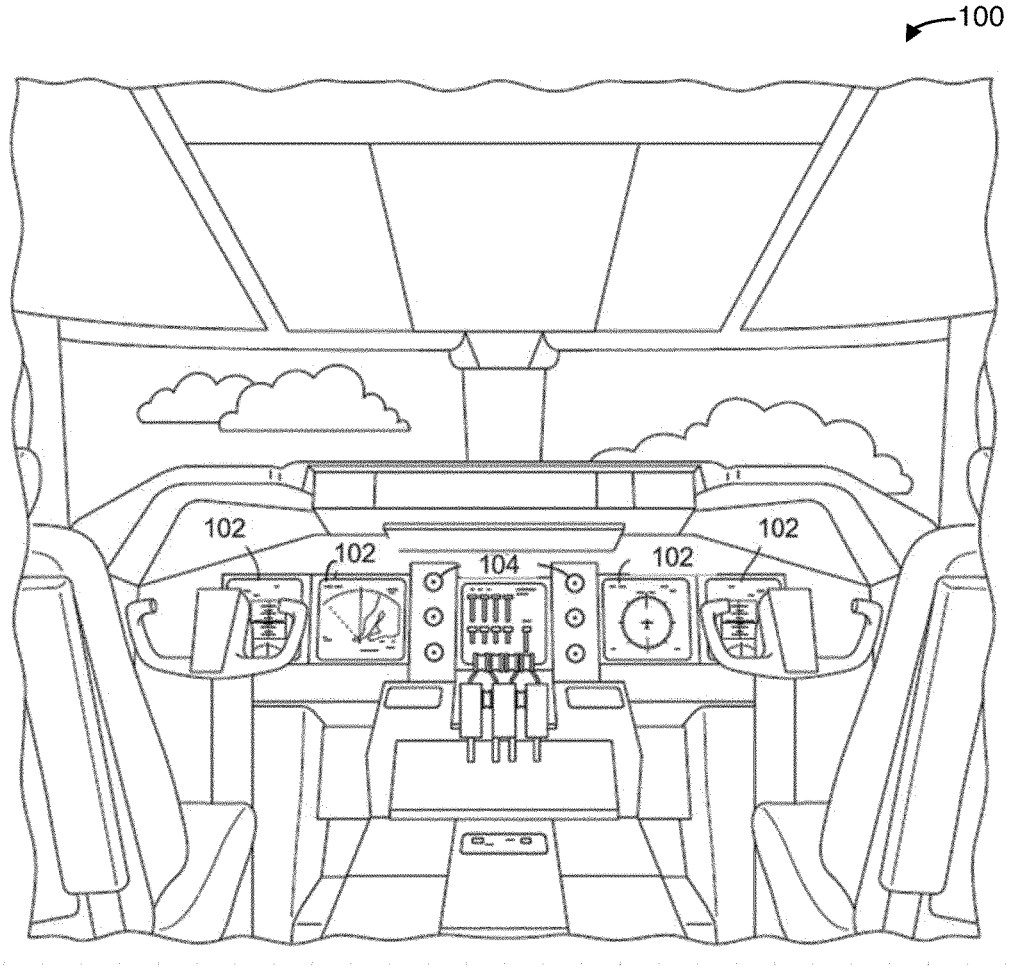
FIG. 1 is a schematic illustration of an exemplary embodiment of a control center of an aircraft, according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein, a letter following a reference numeral is intended to reference an embodiment of the feature or element that may be similar, but not necessarily identical, to a previously described element or feature bearing the same reference numeral (e.g., 1, la, lb). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

As used herein, any reference to "one embodiment" or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination or sub-combination of two or more such features, along with any other features which may not necessarily be expressly described or inherently present in the instant disclosure.

The inventive concepts disclosed herein can be utilized in a number of control systems for various types of applications. While the present disclosure describes systems and methods implementable in an aircraft, the inventive concepts disclosed herein may be used in any type of environment (e.g., in another aircraft, a spacecraft, a ground-based vehicle, drone, a simulator, or in a vehicle or non-vehicle application such as a ground-based display system, an air traffic control system, a radar system, a drone control system, or a virtual display system). While certain examples and embodiments of the inventive concepts disclosed herein are described with respect to a pilot of an aircraft, it will be appreciated that users other than a pilot may use and benefit from some inventive concepts disclosed herein with respect to other vehicles and/or objects.

Broadly, embodiments of the inventive concepts disclosed herein are directed to systems and methods for flight-plan routing of an aircraft based on avoidance traversal analysis. In current and existing systems, navigation systems (e.g., cost-based routing applications) generally divide space into two categories, traversable and non-traversable. For example, a navigation system may calculate a flight path from a starting location to an ending location that avoids all non-traversable space and that minimizes cost. The "cost" of a path may correspond to distance, travel time, fuel spent, or some other variable a user or operator wishes to minimize.

The flight path may involve one or more avoidances, which may relate to inclement weather, flight-restrictions, and other events the aircraft operator may wish to avoid. Although an avoidance may be associated with a number of severity levels, a navigation system may classify an avoidance area as either traversable or non-traversable. This classification system creates a binary representation of a continuous range of avoidances with varying severities. An aircraft operator will then decide whether an avoidance will be avoided or disregarded. The aircraft operator may configure the navigation system to generate a flight path accordingly. However, it may be desirable to travel a distance through the avoidance depending on, for example, the type of avoidance and/or a severity level associated with the avoidance. Although entering a particular avoidance may be undesirable, the aircraft operator may prefer traveling a short distance through that avoidance over travelling around it.

In some embodiments, systems and methods described herein include a processing circuit configured to calculate a cost associated with traversing an avoidance. The processing circuit may be configured to receive avoidance configuration information relating to a plurality of avoidance categories. The avoidance configuration information may be provided as configuration file having one or more look-up tables with avoidance categories, severity levels, and a multiplier value for each severity level. The avoidance configuration information may customizable according to a user-preference.

Each of the avoidance categories may be associated with a number of severity levels. For example, one avoidance category may be a turbulence avoidance category. The turbulence avoidance category may have three severity levels, with one severity level associated with each of light turbulence, moderate turbulence, and severe turbulence. A multiplier value may be associated with each of the three severity levels. In this example embodiment, a second avoidance category may be an icing avoidance category. The icing avoidance category may have three severity levels, with one severity level associated with each of light icing, moderate icing, and severe icing. Because icing may generally be considered more dangerous than turbulence, each of the icing multiplier values may correspond to a larger value relative to each of the turbulence multiplier values. For example, a multiplier value associated light icing may be twice as large as the multiplier value associated with light turbulence. In this regard, each combination of avoidance category and severity level is commensurate with a relative danger or cost.

The processing circuit may be configured to receive flight plan information. The flight plan information may relate to a scheduled flight between from a starting location to a ending location. In this regard, the flight plan information may include a geographic location (e.g., GPS position) associated with each of the starting location and the ending location, a scheduled date and time for the flight, and information relating to a particular avoidance between or proximate to the starting location and the ending location. The processing circuit may be configured to reference the configuration file to identify a multiplier value associated with the avoidance. For example, when the flight plan information indicates the particular avoidance is associated with moderate turbulence, the processing circuit may search the configuration file to identify and retrieve a multiplier value associated with the moderate turbulence. When a flight path involves multiple avoidances, the processing circuit may repeat this process for each avoidance.

The processing circuit may be configured to calculate a cost associated with traversing each avoidance as described herein. When the calculated cost exceeds a predetermined threshold value, the avoidance may be classified as non-traversable. When the calculated cost does not exceed the threshold value, the avoidance may be classified as traversable. The processing circuit may be configured to determine a flight path that avoids non-traversable avoidances and minimizes cost. The processing circuit may be configured to generate a display providing a visual representation relating to avoidance configuration information (e.g., avoidance categories, severity levels), flight plan information (e.g., one or more flight paths, avoidance areas), and/or any other information that may be useful to an operator.

Referring now to FIG. 1, a schematic illustration of an exemplary embodiment of a control center of an aircraft is shown according to some inventive concepts disclosed herein. The aircraft control center 100 (or "cockpit") includes one or more flight displays 102 and one or more user interface (UI) elements 104. The flight displays 102 may be implemented using any of a variety of display technologies, including CRT, LCD, organic LED, dot matrix display, and others. The flight displays 102 may be navigation (NAV) displays, primary flight displays, electronic flight bag displays, tablets such as iPad® computers manufactured by Apple, Inc. or tablet computers, synthetic vision system displays, head up displays (HUDs) with or without a projector, wearable displays, watches, Google Glass® and so on. The flight displays 102 may be used to provide information to the flight crew, thereby increasing the flight crew's visual range and enhancing their decision-making abilities. The flight displays 102 may be configured to function as, for example, a primary flight display (PFD) used to display altitude, airspeed, vertical speed, navigation and traffic collision avoidance system (TCAS) advisories; a crew alert system (CAS) configured to provide alerts to the flight crew; a multi-function display used to display navigation maps, weather radar, electronic charts, TCAS traffic, aircraft maintenance data and electronic checklists, manuals, and procedures; an engine indicating and crew-alerting system (EICAS) display used to display critical engine and system status data, and so on. Other types and functions of the flight displays 102 are contemplated and will be apparent to those skilled in the art.

In some embodiments, the flight displays 102 provide an output from an aircraft-based system, a ground-based system, a satellite-based system, or from a system of another aircraft. In some embodiments, the flight displays 102 provide an output from an aircraft-based weather radar system, LIDAR system, infrared system or other system on the aircraft. For example, the flight displays 102 may include an avionics display, a joint display, an air traffic display, a weather radar map, and a terrain display. The flight displays 102 include an electronic display or a synthetic vision system (SVS). For example, the flight displays 102 may include a display configured to display a two-dimensional (2-D) image, a three-dimensional (3-D) perspective image, or a four-dimensional (4-D) display. Other views of air traffic information, terrain, and/or weather information may also be provided (e.g., plan view, horizontal view, and vertical view). The views shown on the flight displays 102 may include monochrome or color graphical representations of the displayed information, which may include an indication of altitude of other aircraft, weather conditions, or terrain, or the altitude and/or location of such information relative to the aircraft. In some embodiments, the views of the flight display 102 include one or more visual representations relating to an avoidance as described herein.

The UI elements 104 may include, for example, dials, switches, buttons, touch screens, keyboards, a mouse, joysticks, cursor control devices (CCDs) or other multi-function key pads certified for use with avionics systems. The UI elements 104 may be configured to, for example, allow one or more aircraft crew members to interact with various avionics applications and perform functions such as data entry, manipulation of navigational maps, and moving among and selecting checklist items. In some embodiments, the UI elements 104 may be used to provide a user input for adjusting one or more aircraft controls and/or a setting for configuring an aircraft control. For example, the UI elements 104 may be configured to receive an input relating to a desired airspeed, such as an airspeed reference value, threshold values, and the like. The UI elements 104 may also (or alternatively) be used by an aircraft crew member to interface with or manipulate the displays of the flight displays 102. For example, the UI elements 104 may be used by an aircraft crew member to adjust the brightness, contrast, and information displayed on the flight displays 102. The UI elements 104 may additionally be used to acknowledge or dismiss an indicator provided by the flight displays 102.

Further, the UI elements 104 may be used to correct errors on the flight displays 102. Other UI elements 104, such as indicator lights, displays, display elements, and audio alerting devices, may be configured to warn of potentially threatening conditions such as severe weather, terrain, and obstacles.

Figure 2:
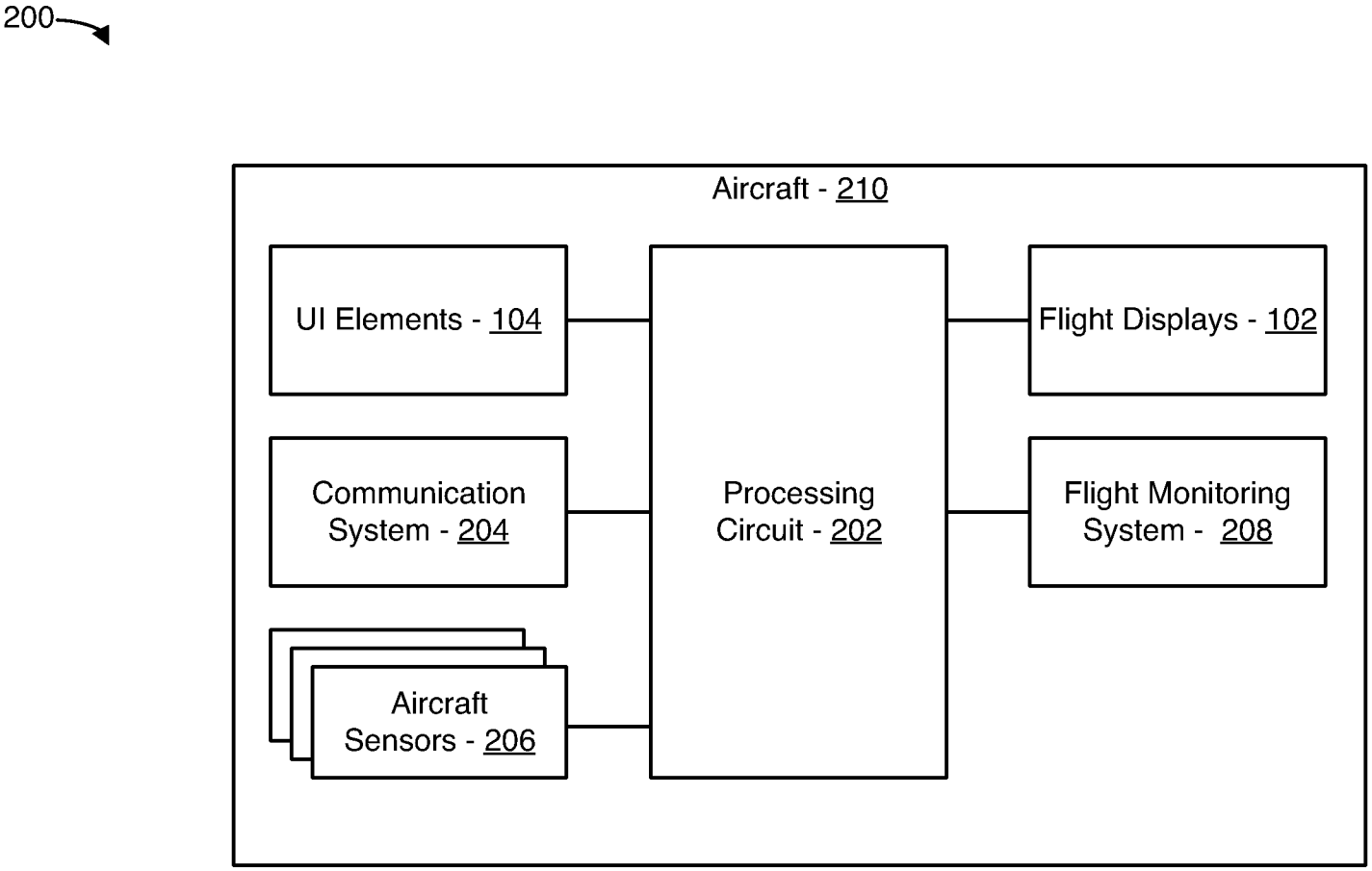
FIG. 2 is a schematic block diagram of a system configured for avoidance traversal analysis for flight-plan routing for the control center illustrated in FIG. 1, according to the inventive concepts disclosed herein.

Referring now to FIG. 2, a system 200 configured for avoidance traversal analysis for flight-plan routing is shown according to the inventive concepts disclosed herein. The system 200 is shown to include a processing circuit 202, the flight displays 102, the UI elements 104, a communication system 204, a plurality of aircraft sensors 206, and a flight monitoring system 208 provided in an aircraft 210 (or an "airborne platform"). In some embodiments, one or more of the processing circuit 202, the flight displays 102, the UI elements 104, the communication system 204, the plurality of aircraft sensors 206, and the flight monitoring system 208 is provided external to the aircraft 210. In some embodiments, the system 200 includes other systems and components for general aircraft operation, such as a weather radar system. The system 200 is part of the aircraft control center 100 (FIG. 1) in some embodiments.

The processing circuit 202 can be configured to send data to and receive data from, or otherwise facilitate electronic data communications, with the other systems of the system 200 and/or with remote systems such as satellite-based systems or ground-based systems. The processing circuit 202 can interface with an aircraft control system, aircraft monitoring system, a navigation system or other such system. The processing circuit 202 can generally be configured to receive input information relating to an avoidance (e.g., inclement weather, a no-fly zone) that may be desirable for the aircraft 210 to avoid. The processing circuit 202 may be configured to calculate a "cost" of traversing an avoidance area in order to determine flight-plan routes and alternative flight-plan routes between two geographic locations. The processing circuit 202 can be configured to generate a three-dimensional or two-dimensional visual representation relating to the flight-plan routes and avoidance areas. In some embodiments, the visual representation is displayed to a user via the flight displays 102. The structure and processes of the processing circuit 202 is shown in greater detail in FIGS. 3-6.

The communication system 204 is configured to facilitate communications between the processing circuit 202 and one or more external systems in some embodiments. For example, the communication system 204 can be configured to send data to and receive data from external ground-based weather supplier systems and ground-based air traffic control systems. The communication system 204 can be configured to communicate with any system, internal or external to the aircraft, such as a satellite system, other aircraft, a terrestrial station, or other air, space, or ground-based system. It should be understood that the information received by the processing circuit 202 as described in the present disclosure can come from any internal or external source. The communication system 204 can be configured to communicate with external systems using any type of communication protocol or network (e.g., via a mobile network, via one or more bi-directional or uni-directional communication channels) and can include any type of wired or wireless interface for facilitating the communication.

The flight monitoring system 208 is configured to acquire flight data indicative of one or more aircraft performance characteristics in some embodiments. The performance characteristics can relate to speed (e.g., indicated airspeed, a true airspeed, groundspeed), acceleration, a pitch angle, a flight path angle, a flap position, a thruster setting, altitude, and/or rate of descent of the aircraft. The flight monitoring system 208 may include at least one of a GPS, a Global Navigation Satellite System (GNSS), an altitude heading and reference system (AHRS), and an inertial reference system (IRS) in some embodiments.

The aircraft sensors 206 may include any number and type of sensors to facilitate operation of the aircraft 210, including components and systems provided therein. For example, the aircraft sensors 206 may include, for example, one or more devices or instruments configured for tracking airspeed (e.g., indicated airspeed, a true airspeed, and groundspeed) and/or location (e.g., GPS). In some embodiments, the aircraft sensors 206 include fuel sensors, turbulence sensors, pressure sensors, optical systems (e.g., camera system, infrared system), weather sensors, such as outside air temperature sensors, winds at altitude sensors, INS G load (in-situ turbulence) sensors, barometric pressure sensors, humidity sensors, or any other aircraft sensors or sensing system that may be used to monitor the performance of an aircraft or weather local to or remote from the aircraft. The aircraft sensors 206 may be located in various positions on the aircraft, and a single sensor may be configured to acquire more than one type of sensor data. In some embodiments, one or more of the sensors 206 are provided with the flight monitoring system 208. Data from the aircraft sensors 206 may be output to the processing circuit 202, the communication system 204, the flight displays 102, and/or the flight monitoring system 208 as described herein.

Figure 3:
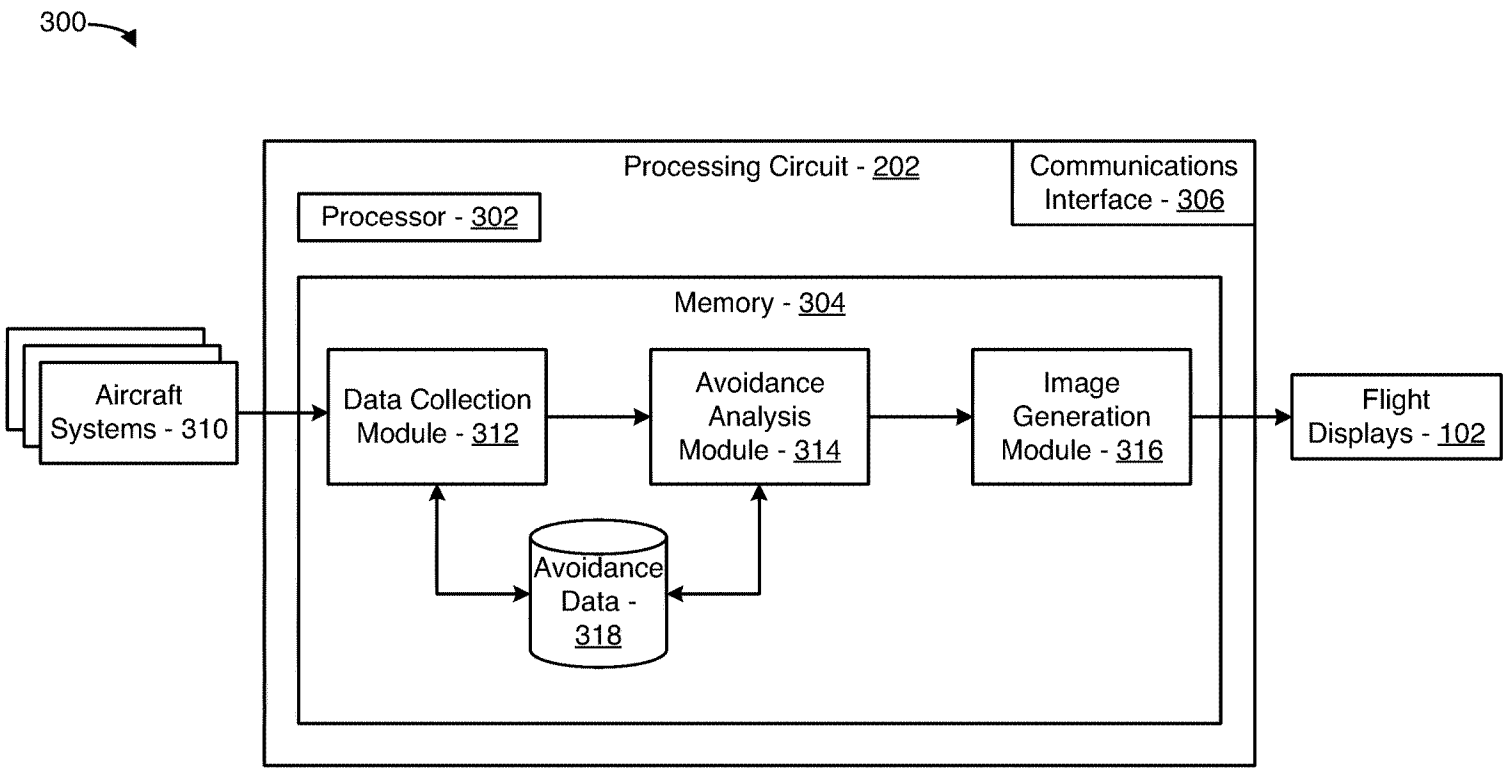
FIG. 3 is a schematic block diagram of a processing circuit of the system configured for avoidance traversal analysis for flight-plan routing illustrated in FIG. 2, according to the inventive concepts disclosed herein.

Referring to FIG. 3, a block diagram of the processing circuit 202 configured for avoidance traversal analysis for flight-plan routing is shown in further detail according to some inventive concepts disclosed herein. The processing circuit 202 is shown to include a processor 302, a memory 304, and a communications interface 306. The communications interface 306 can be a wired or wireless interface configured to facilitate communications between the processing circuit 202 and the other components and systems of the system 200. The processor 302 can be implemented as a general or specific purpose processor, an application specific integrated circuit (ASIC), one or more field programmable gate arrays (FPGAs), a group of processing components, or other suitable electronic processing components.

The memory 304 is one or more devices (e.g., RAM, ROM, flash memory, hard disk storage) for storing data and computer code for completing and facilitating the various user or client processes, layers, and modules described in the present disclosure. The memory 304 may be or include volatile memory or non-volatile memory and may include database components, object code components, script components, or any other type of information structure for supporting the various activities and information structures of some inventive concepts disclosed herein. The memory 304 is communicably connected to the processor 302 and includes computer code or instruction modules for executing one or more processes described herein. The memory 304 can include various circuits, software engines, and/or modules that cause the processor 302 to execute the systems and methods described herein. In some embodiments, the processing circuit 202 also includes a graphics processing unit (GPU) (not shown), which can be configured to retrieve electronic instructions for generating a visual representation for one or more of the flight displays 102 and execute the electronic instructions in order to generate the visual representation.

The memory 304 is shown to include a data collection module 312, an avoidance analysis module 314, an image generation module 316, and an avoidance data database 318. In some embodiments, the data collection module 312, the avoidance analysis module 314, the image generation module 316, and/or the avoidance data database 318 are embodied as machine or computer-readable media that is executable by a processor, such as the processor 302. As described herein and amongst other uses, the machine-readable media facilitates performance of certain operations to enable determining a dynamic airspeed reference value. For example, the machine-readable media can provide an instruction (e.g., command, etc.) to acquire data. In this regard, the machine-readable media is a non-transitory media and can include programmable logic that defines the frequency of acquisition of the data (or, transmission of the data). The computer readable media can include code, which can be written in any programming language including, but not limited to, Java or the like and any conventional procedural programming languages, such as the "C" programming language or similar programming languages. The computer readable program code can be executed on one processor or multiple remote processors. In the latter scenario, the remote processors can be connected to each other through any type of network (e.g., CAN bus, etc.).

In another configuration, the data collection module 312, the avoidance analysis module 314, the image generation module 316, and/or the avoidance data database 318 are embodied as hardware units, such as electronic control units. As such, the data collection module 312, the avoidance analysis module 314, the image generation module 316, and/or the avoidance data database 318 can be embodied as one or more circuitry components including, but not limited to, processing circuitry, network interfaces, peripheral devices, input devices, output devices, sensors, etc.

In some embodiments, the data collection module 312, the avoidance analysis module 314, the image generation module 316, and/or the avoidance data database 318 can take the form of one or more analog circuits, electronic circuits (e.g., integrated circuits (IC), discrete circuits, system on a chip (SOCs) circuits, microcontrollers, etc.), telecommunication circuits, hybrid circuits, and any other type of "circuit." In this regard, the data collection module 312, the avoidance analysis module 314, the image generation module 316, and/or the avoidance data database 318 can include any type of component for accomplishing or facilitating achievement of the operations described herein. For example, a circuit as described herein can include one or more transistors, logic gates (e.g., NAND, AND, NOR, OR, XOR, NOT, XNOR, etc.), resistors, multiplexers, registers, capacitors, inductors, diodes, wiring, and so on), and programmable hardware devices (e.g., field programmable gate arrays, programmable array logic, programmable logic devices or the like). The data collection module 312, the avoidance analysis module 314, the image generation module 316, and/or the avoidance data database 318 can each include a processor and one or more memory devices for storing instructions that are executable by each of the processors. The one or more memory devices and processor(s) can have the same definition as provided herein with respect to the memory 304 and the processor 302.

In some hardware unit configurations, the data collection module 312, the avoidance analysis module 314, the image generation module 316, and/or the avoidance data database 318 can be physically located in separate locations in the processing circuit 202. Alternatively, the data collection module 312, the avoidance analysis module 314, the image generation module 316, and/or the avoidance data database 318 can be embodied in or within a single unit/housing of the processing circuit 202. In some embodiments, the data collection module 312, the avoidance analysis module 314, the image generation module 316, and/or the avoidance data database 318 can be a hybrid of any device disclosed above, such as a specific purpose processor or task execution unit (e.g., configured to execute a micro node) with additional circuity specifically configured to execute bandwidth calculations, frame analysis, or routing determinations.

The data collection module 312 is configured to gather data from the aircraft systems 310 and/or the avoidance data database 318 in some embodiments. The aircraft systems 310 may include any component, device, or system of the system 200 (e.g., the UI elements 104, the communication system 204, the aircraft sensors 206, and/or the flight monitoring system 208). In some embodiments, gathered data may relate to avoidance configuration information, flight plan information, and/or any other information for avoidance traversal analysis for flight-plan routing as described herein. In some embodiments, the data collection module 312 is configured to automatically gather information from one or more of the aircraft systems 310. In this regard, the data collection module 312 may be configured to communicate a command or request to the one or more of the aircraft systems 310 with an instruction to provide information from one or more of the aircraft systems 310.

The data collection module 312 may be configured to receive avoidance configuration information in some embodiments. The avoidance configuration information may be provided as configuration file having one or more look-up tables. The avoidance configuration information may relate to a plurality of avoidance categories, where each of the avoidance categories has a number of severity levels. Each avoidance category may correspond to an event or situation in which it may be desirable for the aircraft 210 to avoid. For example, an avoidance category may relate to a turbulence avoidance category. The turbulence avoidance category may have three severity levels, with one severity level associated with each of light turbulence, moderate turbulence, and severe turbulence.

Any number and type of avoidance categories may be provided in various embodiments. In some embodiments, one or more avoidance categories relate to significant meteorological information (SIGMET), airmen's meteorological information (AIRMET), a flight restriction (e.g., a temporary flight restriction), volcanic ash, turbulence, inclement weather (e.g., thunderstorms), icing, mountain obscuration, and/or other aircrafts or any other moving entity or event which it may be desirable for the aircraft 210 to avoid. In some embodiments, the number and type of avoidance categories are selected according to a user preference and are configured within a configuration file.

Each avoidance category may have a number of severity levels, and each severity level may be associated with a multiplier value. In this regard, each combination of avoidance category and severity level is associated with a multiplier value. The multiplier value may be indicative of a relative danger or severity. As described herein, the multiplier value may be used for calculating a normalized cost associated with traversing an avoidance area. Each multiplier value may be expressed as a quantitative value (e.g., zero or larger), a non-quantitative value, and/or a formula as described herein.

In one example embodiment, a configuration file may include a first avoidance category relating to turbulence and a second avoidance category relating to icing. The turbulence avoidance category may have three severity levels, with one severity level associated with each of light turbulence, moderate turbulence, and severe turbulence. A progressively increasing multiplier value may be associated with each of the three turbulence severity levels. For example, a multiplier value associated moderate turbulence may be equal to two times the multiplier value associated light turbulence. Similarly, a multiplier value associated high turbulence may be equal to three times the multiplier value associated with light turbulence.

Still referring to the example embodiment, the icing avoidance category may also have three severity levels, with one severity level associated with each of light icing, moderate icing, and severe icing. A progressively increasing multiplier value may be associated with each of the three icing severity levels. However, because icing may be considered more dangerous than turbulence, each of the icing multiplier values may correspond to a larger value relative to each of the turbulence multiplier values. For example, a multiplier value associated light icing may be equal to three times the multiplier value associated with light turbulence. In this regard, a multiplier value associated with each combination of avoidance category and severity level is indicative of a relative severity with respect to other combinations.

Each avoidance category may be associated with any number of severity levels. Referring to the above example embodiment, the configuration file may include a third avoidance category relating to volcanic ash. The volcanic ash avoidance category may only have one severity level relating to whether volcanic ash is present, and the multiplier value associated with the one severity level may similarly be commensurate with a relative severity or danger. For example, the multiplier value may be equal to six times the multiplier value associated with light turbulence. The configuration file may also include a fourth avoidance category relating to SIGMET, which may have one severity level for each of fifteen SIGMET types. In this example, each of the fifteen severity levels may be associated with an identical multiplier value when each of the fifteen SIGMET types represents a sufficiently similar severity.

Each avoidance category may be associated with any type of severity level, which may correspond to a non-quantitative value in some embodiments. Referring to the above example embodiment, the configuration file may include a fifth avoidance category corresponding to a flight restriction (e.g., a temporary flight restriction). The flight restriction may have one severity level relating to whether a flight restriction is present. A quantitative multiplier may not be provided because the temporary flight restriction may not be traversable in any circumstance.

In some embodiments, the avoidance configuration information may be customized according to a user preference. For example, it may be desirable for to adjust a multiplier value based on a size or performance characteristics of the aircraft 210. When the aircraft 210 has a large overall size, for example, it may be less susceptible to turbulence. In this regard, it may be desirable to nominally decrease a multiplier value corresponding to one or more severity levels associated with the turbulence category.

In some embodiments, the avoidance configuration information is provided as a configuration file. In some embodiments, the configuration file is received via the communication system 204. In some embodiments, the configuration file may be stored in the avoidance data database 318. Avoidance configuration information may be adjusted by an operator, for example via the UI elements 104. The updated avoidance configuration information may be stored as a configuration file in the avoidance data database 318.

The data collection module 312 is configured to receive flight plan information in some embodiments. The flight plan information may be based on a flight path between two or more particular geographic locations at a scheduled date and time. For example, the flight plan information may include information relating to navigation or GPS data of a particular starting location and a particular ending location. The flight plan information plan may include information relating to an avoidance area, an indication of an avoidance category corresponding to the avoidance area, and an indication of a severity level corresponding to the avoidance area. The flight plan information may include SIGMET, AIRMET, and other information relating to one or more avoidance areas that may be intersected by or proximate to the flight path. In this regard, the flight plan information may include a severity level associated with each of the avoidance areas. For example, the flight plan information may include an indication of an avoidance area associated with turbulence, having a severity level of moderate. The flight plan information may additionally include an indication of a particular geographic area or space associated with the avoidance area, facilitating a two-dimensional display of the avoidance area.

The data collection module 312 may be configured to provide collected data to the avoidance analysis module 314. In some embodiments, the data collection module 312 is configured to store collected data in the avoidance data database 318. In this regard, the avoidance data database 318 is configured to store data relating to avoidance configuration information, flight plan information, and/or any other data. One or more modules of the processing circuit 202 (e.g., the data collection module 312, the avoidance analysis module 314) may be configured to store data in the avoidance data database 318 and/or to retrieve stored data from the avoidance data database 318.

The avoidance analysis module 314 is configured to calculate a normalized cost of an avoidance-traversing flight path in some embodiments. The normalized cost may correspond to distance, travel time, energy usage (e.g., fuel, electricity) or any suitable parameter that may be desirable to minimize. In some embodiments, the avoidance analysis module 314 calculates a normalized cost based on information received from the data collection module 312. In some embodiments, the avoidance analysis module 314 additionally or alternatively calculates a normalized cost based on information stored in the avoidance data database 318. In this regard, data stored in the avoidance data database 318 may be selectively retrieved by the avoidance analysis module 314 as described herein. The activities of the avoidance analysis module 314 are explained in greater detail with respect to FIG. 6.

The image generation module 316 can be configured to generate a display providing a visual representation relating to avoidance configuration information (e.g., avoidance categories, severity levels), flight plan information (e.g., one or more flight paths, one or more avoidance areas), the aircraft 210 and/or any other information that may be useful to an operator. The image generation module 316 can be configured to generate the visual representation for display by one or more of the flight displays 102. In some embodiments, the visual representation is provided as a two-dimensional perspective of one or more alternative flight routes. For example, a first route may involve the aircraft 210 traversing a portion of one or more avoidance areas. The image generation module 316 may be configured to generate a display that additionally or alternatively includes a second route in which the aircraft 210 does not traverse an avoidance area. The display of the second route may be provided as an overlay to the display of the first route in some embodiments.

In some embodiments, the image generation module 316 is configured to provide an indication relating a flight path and/or an avoidance area. For example, when an avoidance area corresponds to a traversable avoidance area, the visual representation of the avoidance area may be provided as a particular color, shade, and/or pattern. A different color, shade, and/or pattern may be used when the avoidance area corresponds to a non-traversable avoidance area.

In some embodiments, the image generation module 316 can be configured to display other information that may be useful to the operator, such as information received from the communication system 204, the flight monitoring system 204 (e.g., a current position), information received from the sensors 206, etc. The generated display may additionally include information relating to a normalized cost, threshold values, and the like. The image generation module 316 may configure the generated display according to a user input (e.g., via the UI elements 104) in some embodiments.

Figure 4:
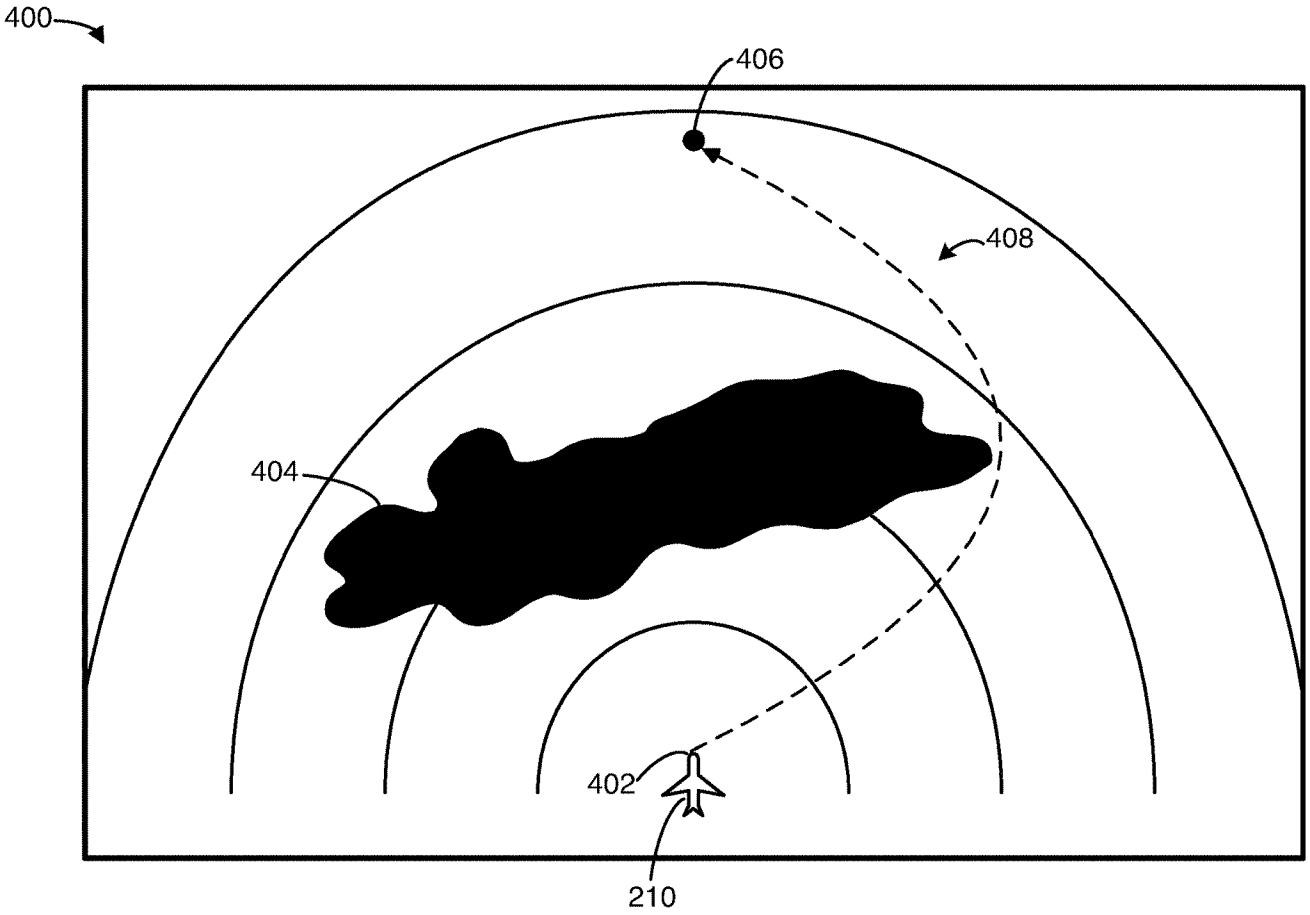
FIG. 4 is an example screenshot of a display configured for avoidance traversal analysis for flight-plan routing provided on an aircraft display device, according to the inventive concepts disclosed herein.

Referring to FIG. 4, an example screenshot 400 shows a visualization of a flight path 408 of the aircraft 210 between a starting location 402 and an end location 406. The screenshot 400 shows a non-traversable avoidance area 404. The processing circuit 202 may have determined the avoidance area 404 as non-traversable as described herein. Accordingly, the flight path 408 is configured to not intersect the non-traversable avoidance area 404. The flight path 408 represents the least cost (e.g., distance) for travelling between starting location 402 and end location 406. The visualization may have been generated by the processing circuit 202 as described herein, and the visualization may be provided on one of the displays 102 in some embodiments.

Figure 5:
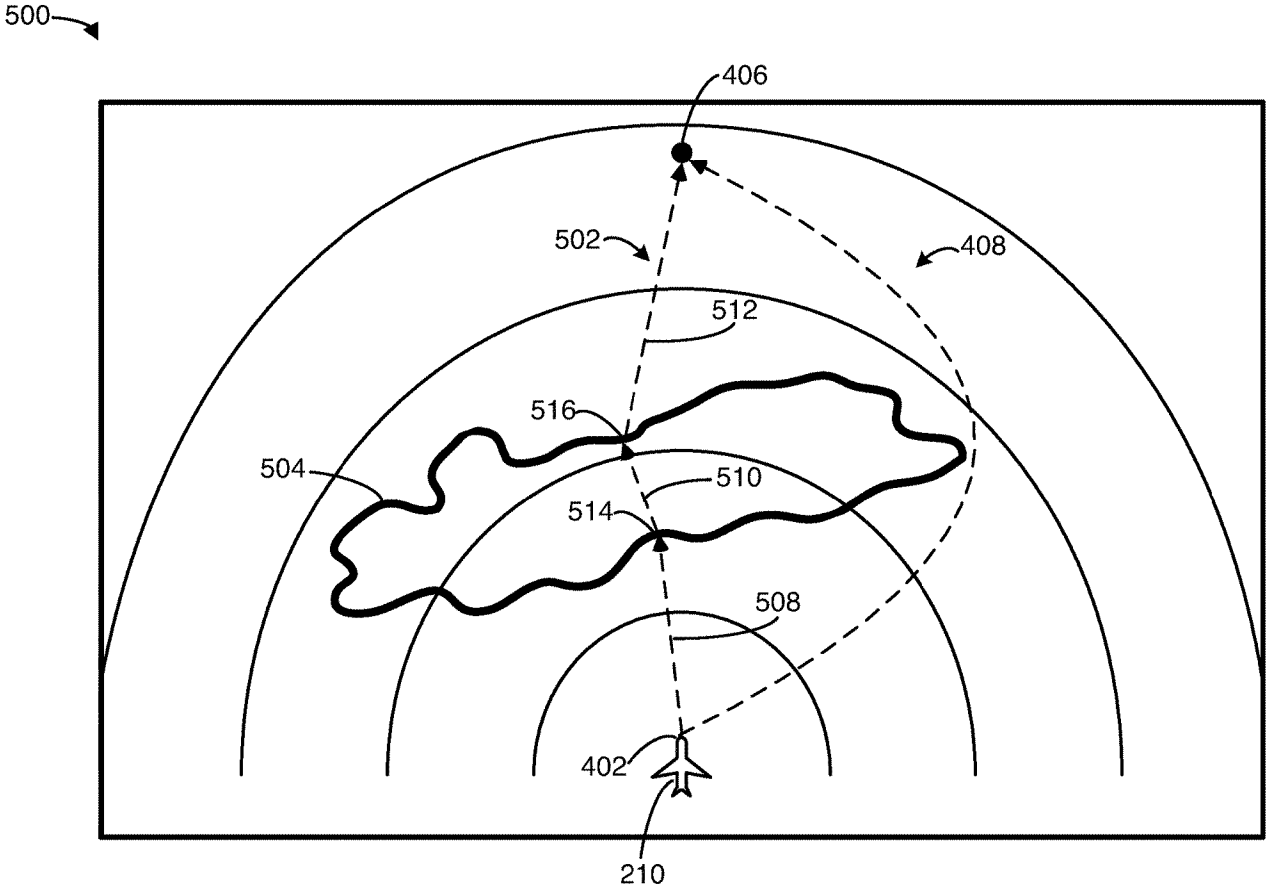
FIG. 5 is another example screenshot of a display configured for avoidance traversal analysis for flight-plan routing provided on an aircraft display device, according to the inventive concepts disclosed herein.

FIG. 5 shows another example screenshot 500 with the aircraft 210 travelling between the starting location 402 and the end location 406. The screenshot 500 shows a traversable avoidance area 504 and a flight path 502 having three segments 508, 510, and 512. The processing circuit 202 may have determined the avoidance area 504 as traversable as described herein. The processing circuit 202 may have determined flight path 502 as a lowest normalized cost for travelling between the starting location 402 and the end location 406 as described herein. The flight path 502 intersects an edge of the avoidance area 504 at point 514 and traverses the avoidance area 504 through point 516. The portion of the flight path between point 514 and point 516 define avoidance-traversing segment 510. The traversable avoidance area 504 may be provided as a different color, shade, and/or pattern relative to the non-traversable avoidance area 404 shown in the screenshot 400.

Figure 6:
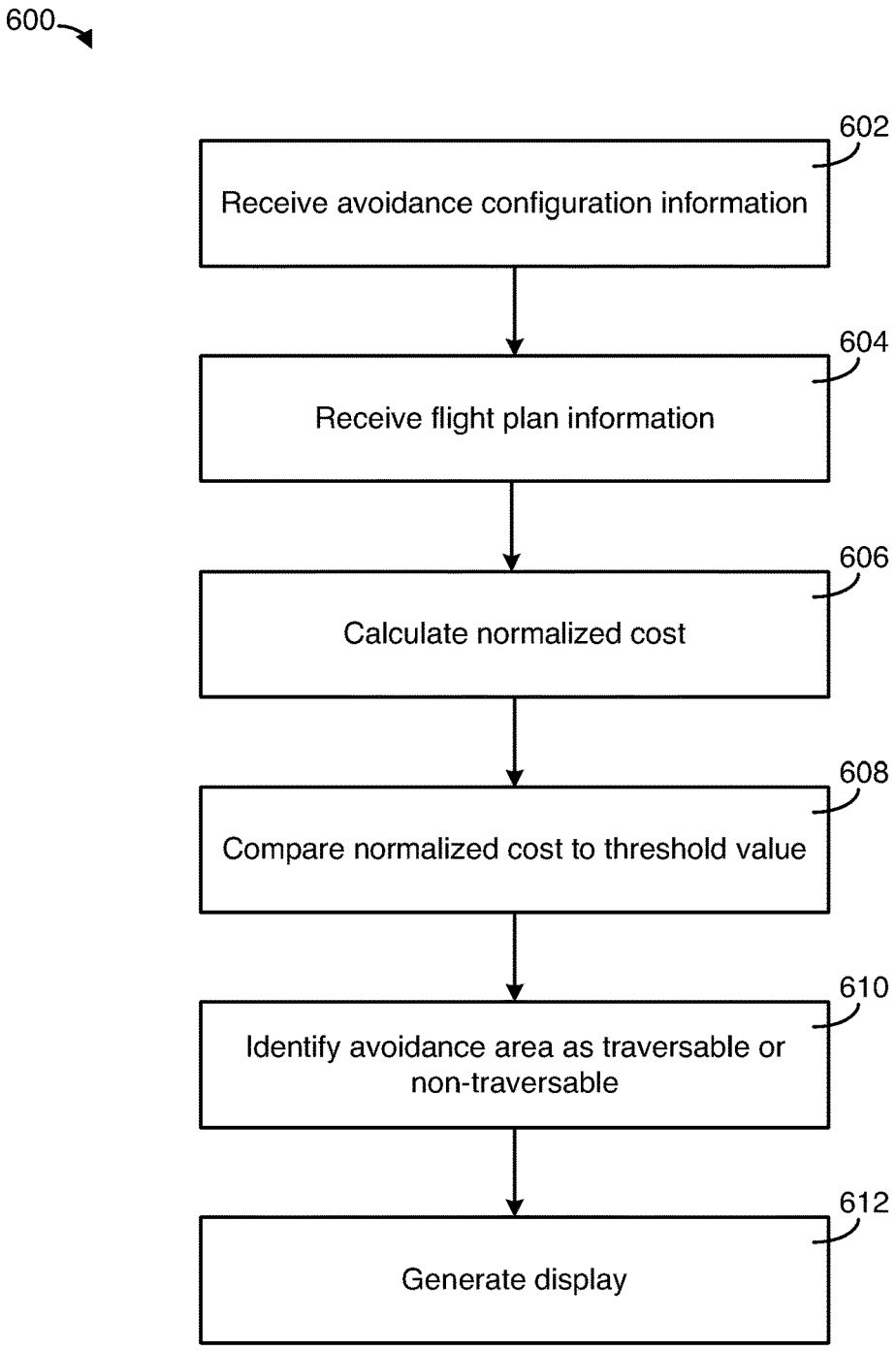
FIG. 6 is a flow diagram showing exemplary operations for avoidance traversal analysis for flight-plan routing of the system illustrated in FIG. 2, according to the inventive concepts disclosed herein.

Referring now to FIG. 6, an operational flow 600 of a process for avoidance traversal analysis for flight-plan routing is shown according to the inventive concepts disclosed herein. In some embodiments, the embodiment described below may be performed by one or more processing circuits, such as the processing circuit 202. In some embodiments, the operational flow 600 may be performed using various hardware, apparatuses, and systems such as described herein.

At an operation 602, a processing circuit receives avoidance configuration information. In some embodiments, the avoidance configuration is received as a configuration file. The avoidance configuration may relate to a plurality of avoidance categories, each of the avoidance categories having a number of severity levels. Each of the severity levels may be associated with a multiplier value selected from a set of multiplier values. In this regard, each combination of avoidance category and severity level corresponds to a multiplier value. The multiplier value may be indicative of a relative danger or severity. As described herein, the multiplier value may be used for calculating a normalized cost associated with traversing an avoidance area. Each multiplier value may be expressed as a quantitative value (e.g., zero or larger), a non-quantitative value, and/or a formula as described herein.

At an operation 604, the processing circuit receives flight plan information. The flight plan information may be based on a flight path between two or more particular geographic locations at a scheduled date and time. In some embodiments, the flight plan information may include information relating to navigation or GPS data of a particular starting location (e.g., the starting location 402) and a particular ending location (e.g., the ending location 406).

The flight plan information plan may include information relating to an avoidance area an indication of an avoidance category corresponding to the avoidance area, and an indication of a severity level corresponding to the avoidance area. The flight plan information may include SIGMET, AIRMET, and other information relating to one or more avoidance areas that may be intersected by or proximate to the flight path. In this regard, the flight plan information may include a severity level associated with each of the avoidance areas. For example, the flight plan information may include an indication of an avoidance area associated with turbulence, having a severity level of moderate. The flight plan information may additionally include an indication of a particular geographic area or space associated with the avoidance area (e.g., the avoidance area 404, the avoidance area 504).

At an operation 606, the processing circuit (e.g., the avoidance analysis module 314) calculates a normalized cost associated with an avoidance-traversing segment. For example, referring to FIG. 5, the avoidance-traversing segment 510 is shown as a segment between locations 514, 516, where the aircraft 210 enters the avoidance area at location 514 and exits the avoidance area at location 516. In some embodiments, the normalized cost is equal to a sum of: the distance value of the avoidance-traversing segment (e.g., the segment 510), and the distance value of the avoidance-traversing segment multiplied by the multiplier value. In some embodiments, a flight path may be associated with multiple avoidance areas. In this regard, the processing circuit calculates a normalized cost of the avoidance-traversing segment for each avoidance area.

In some embodiments, the processing circuit calculates a total cost of the flight route. In some embodiments, the total cost of the flight route is equal to a sum of each distance value associated with an avoidance-traversing segment and each distance value associated with a non-traversing segment. Referring to FIG. 5, the flight path 502 includes a first non-traversing segment between starting location 402 and entrance point 514 and a second non-traversing segment between exit point 516 and ending location 406.

The normalized cost may relate to distance in some embodiments. In other embodiments, the normalized cost may relate to time, fuel usage, or battery usage. In this regard, the normalized cost may be determined using a performance charts relating to the aircraft 210.

At an operation 608, the processing circuit compares the normalized cost to a threshold value. When the normalized cost exceeds the threshold value, the processing circuit identifies the avoidance area as non-traversable (operation 610) in some embodiments. When the normalized cost does not exceed the threshold value, the processing circuit identifies the avoidance area as traversable in some embodiments. In some embodiments, the threshold value is a predetermined value and stored in the configuration file. In this regard, the threshold value may be configured according to a user preference.

At an operation 610, the processing circuit generates a display. The display may be configured to provide a visual representation of at least one flight path, avoidance-traversing segment, non-traversing segment, and/or avoidance area, for example as shown with reference to FIG. 5. In some embodiments, the visual representation includes information relating to a normalized cost, a total flight cost, and/or a flight path that does not intersect an avoidance area. In some embodiments, the generated display is provided by one or more of the flight displays 102.

In some embodiments, the generated display includes indication relating whether an avoidance area is identified as traversable. For example, when an avoidance area corresponds to a traversable avoidance area, a visual representation of the avoidance area may be provided as a particular color, shade, and/or pattern. A different color, shade, and/or pattern may be used when the avoidance area corresponds to a non-traversable avoidance area.

The scope of this disclosure should be determined by the claims, their segmental equivalents and the fact that it fully encompasses other embodiments, which may become apparent to those skilled in the art. All structural, electrical and functional equivalents to the elements of the above-described disclosure that are known to those of ordinary skill in the art are expressly incorporated herein by reference and are intended to be encompassed by the present claims. A reference to an element in the singular is not intended to mean one and only one, unless explicitly so stated, but rather it should be construed to mean at least one. No claim element herein is to be construed under the provisions of 35 U.S.C. § 112, sixth paragraph, unless the element is expressly recited using the phrase "means for." Furthermore, no element, component or method step in the present disclosure is intended to be dedicated to the public, regardless of whether the element, component or method step is explicitly recited in the claims.

Embodiments of the inventive concepts disclosed herein have been described with reference to drawings. The drawings illustrate certain details of specific embodiments that implement the systems and methods and programs of the present disclosure. However, describing the embodiments with drawings should not be construed as imposing any limitations that may be present in the drawings. The present disclosure contemplates methods, systems and program products on any machine-readable media for accomplishing its operations. Embodiments of the inventive concepts disclosed herein may be implemented using an existing computer processor, or by a special purpose computer processor incorporated for this or another purpose or by a hardwired system.

Embodiments of the inventive concepts disclosed herein have been described in the general context of method steps which may be implemented in one embodiment by a program product including machine-executable instructions, such as program code, for example in the form of program modules executed by machines in networked environments. Generally, program modules include routines, programs, objects, components, data structures, etc. that perform particular tasks or implement particular abstract data types. Machine-executable instructions, associated data structures, and program modules represent examples of program code for executing steps of the methods disclosed herein. The particular sequence of such executable instructions or associated data structures represent examples of corresponding acts for implementing the functions described in such steps.

It should be noted that although the diagrams herein may show a specific order and composition of method steps, it is understood that the order of these steps may differ from what is depicted. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative embodiments. Accordingly, all such modifications are intended to be included within the scope of the present disclosure.

The foregoing description of embodiments has been presented for purposes of illustration and description. It is not intended to be exhaustive or to limit the subject matter to the precise form disclosed, and modifications and variations are possible in light of the above teachings or may be acquired from practice of the subject matter disclosed herein. The embodiments were chosen and described in order to explain the principals of the disclosed subject matter and its practical application to enable one skilled in the art to utilize the disclosed subject matter in various embodiments and with various modifications as are suited to the particular use contemplated. Other substitutions, modifications, changes and omissions may be made in the design, operating conditions and arrangement of the embodiments without starting from the scope of the presently disclosed subject matter.

What is claimed is:

1. A method comprising:

receiving, by a processing circuit, avoidance configuration information, the avoidance configuration information having a plurality of avoidance categories, each of the avoidance categories having a number of severity levels, each of the severity levels associated with a multiplier value selected from a set of multiplier values;

receiving, by the processing circuit, flight plan information relating to a flight route from a starting location to an ending location, an avoidance area, an indication of an avoidance category corresponding to the avoidance area, and an indication of a severity level corresponding to the avoidance area, wherein the flight route includes at least one avoidance-traversing segment, the avoidance-traversing segment corresponding to a portion of the flight route within the avoidance area;

calculating, by the processing circuit, a normalized cost associated with the flight route, the normalized cost based on a distance of the avoidance-traversing segment and on the multiplier value associated with the severity level corresponding to the avoidance area;

comparing, by the processing circuit, the normalized cost associated with the flight route to a threshold value;

identifying, by the processing circuit, the avoidance area as non-traversable when the normalized cost associated with the flight route exceeds the threshold value; and generating, by the processing circuit, a display providing a visual representation of at least one of the normalized cost, the flight route, and the avoidance area.

2. The method of claim 1, wherein the plurality of avoidance categories corresponds to at least one of: turbulence, icing, AIRMET Sierra, SIGMET, and volcanic ash.

3. The method of claim 1, wherein the plurality of avoidance categories comprises an avoidance category corresponding to a temporary flight restriction, the temporary flight restriction having one severity level, the severity level having either a first value indicating an active temporary flight restriction or a second value indicating an absence of the active temporary flight restriction, wherein the processing circuit identifies an avoidance area as non-traversable when the flight plan information relates to an avoidance category corresponding to the temporary flight restriction and the severity level having the first value.

4. The method of claim 1, further comprising:

calculating, by the processing circuit, a first distance value associated with a first non-traversing segment, wherein the first non-traversing segment corresponds to a portion of the flight route between the starting location and an entrance point of the avoidance area;

calculating, by the processing circuit, a second distance value associated with a second non-traversing segment, wherein the second non-traversing segment corresponds to a portion of the flight route between an exit point of the avoidance area and the ending location;

calculating, by the processing circuit, a total cost of the flight route, the total cost equal to a sum of a third distance value associated with the avoidance-traversing segment, the first distance value associated with the first non-traversing segment, and the second distance value associated with the second non-traversing segment; and generating, by the processing circuit, a display image providing a visual representation of total cost of the flight route.

5. The method of claim 1, wherein the visual representation of the avoidance area is provided as a first color in response to identifying the avoidance area as traversable and wherein the visual representation of the avoidance area is provided as a second color in response to identifying the avoidance area as non-traversable.

6. The method of claim 1, wherein the normalized cost is equal to a sum of: the distance value of the avoidance-traversing segment, and the distance value of the avoidance-traversing segment multiplied by the multiplier value.

7. The method of claim 1, wherein the normalized cost is calculated based on an amount of fuel usage value associated with the avoidance-traversing segment.

8. A processing circuit of an aircraft, the processing circuit having a processor and a memory, and configured to:

receive avoidance configuration information, the avoidance configuration information having a plurality of avoidance categories, each of the avoidance categories having a number of severity levels, each of the severity levels associated with a multiplier value selected from a set of multiplier values;

receive flight plan information, flight plan information relating to a flight route from a starting location to an ending location, an avoidance area, an indication of an avoidance category corresponding to the avoidance area, and an indication of a severity level corresponding to the avoidance area, wherein the flight route includes at least one avoidance-traversing segment, the avoidance-traversing segment corresponding to a portion of the flight route within the avoidance area;

calculate a normalized cost associated with the flight route, the normalized cost based on a distance of the avoidance-traversing segment and on the multiplier value associated with the severity level corresponding to the avoidance area;

compare the normalized cost associated with the flight route to a threshold value;

identify the avoidance area as non-traversable when the normalized cost associated with the flight route exceeds the threshold value; and generate a display providing a visual representation of at least one of the normalized cost, the flight route, and the avoidance area.

9. The processing circuit of claim 8, wherein the plurality of avoidance categories corresponds to at least one of: turbulence, icing, AIRMET Sierra, SIGMET, and volcanic ash.

10. The processing circuit of claim 8, wherein the plurality of avoidance categories comprises an avoidance category corresponding to a temporary flight restriction, the temporary flight restriction having one severity level, the severity level having either a first value indicating an active temporary flight restriction or a second value indicating an absence of the active temporary flight restriction, wherein the processing circuit identifies an avoidance area as non-traversable when the flight plan information relates to an avoidance category corresponding to the temporary flight restriction and the severity level having the first value.

11. The processing circuit of claim 8, wherein the visual representation of the avoidance area is provided as a first color in response to identifying the avoidance area as traversable and wherein the visual representation of the avoidance area is provided as a second color in response to identifying the avoidance area as non-traversable.

12. The processing circuit of claim 8, wherein the normalized cost is equal to a sum of: a first distance value of the avoidance-traversing segment, and the first distance value of the avoidance-traversing segment multiplied by the multiplier value.

13. The processing circuit of claim 8, wherein the normalized cost is calculated based on an amount of fuel usage value associated with the avoidance-traversing segment.

14. A system for an airborne platform, comprising:

a display device configured to provide a display; and a processing circuit communicably coupled to the display device, the processing circuit configured to:

receive avoidance configuration information, the avoidance configuration information having a plurality of avoidance categories, each of the avoidance categories having a number of severity levels, each of the severity levels associated with a multiplier value selected from a set of multiplier values;

receive flight plan information, flight plan information relating to a flight route from a starting location to an ending location, an avoidance area, an indication of an avoidance category corresponding to the avoidance area, and an indication of a severity level corresponding to the avoidance area, wherein the flight route includes at least one avoidance-traversing segment, the avoidance-traversing segment corresponding to a portion of the flight route within the avoidance area;

calculate a normalized cost associated with the flight route, the normalized cost based on a distance of the avoidance-traversing segment and on the multiplier value associated with the severity level corresponding to the avoidance area;

compare the normalized cost associated with the flight route to a threshold value;

identify the avoidance area as non-traversable when the normalized cost associated with the flight route exceeds the threshold value; and generate a display image providing a visual representation of at least one of the normalized cost, the flight route, and the avoidance area.

15. The system of claim 14, wherein the plurality of avoidance categories corresponds to at least one of: turbulence, icing, AIRMET Sierra, SIGMET, and volcanic ash.

16. The system of claim 14, wherein the plurality of avoidance categories comprises an avoidance category corresponding to a temporary flight restriction, the temporary flight restriction having one severity level, the severity level having either a first value indicating an active temporary flight restriction or a second value indicating an absence of the active temporary flight restriction; wherein the processing circuit identifies an avoidance area as non-traversable when the flight plan information relates to an avoidance category corresponding to the temporary flight restriction and the severity level having the first value.

17. The system of claim 14, wherein the processing circuit is further configured to:

calculate a first distance value associated with a first non-traversing segment, wherein the first non-traversing segment corresponds to a portion of the flight route between the starting location and an entrance point of the avoidance area;

calculate a second distance value associated with a second non-traversing segment, wherein the second non-traversing segment corresponds to a portion of the flight route between an exit point of the avoidance area and the ending location;

calculate a total cost of the flight route, the total cost equal to a sum of a third distance value associated with the avoidance-traversing segment, the first distance value associated with the first non-traversing segment, and the second distance value associated with the second non-traversing segment; and generate a display image providing a visual representation of total cost of the flight route.

18. The system of claim 14, wherein the visual representation of the avoidance area is provided as a first color in response to identifying the avoidance area as traversable and wherein the visual representation of the avoidance area is provided as a second color in response to identifying the avoidance area as non-traversable.

19. The system of claim 14, wherein the normalized cost is equal to a sum of: a distance value of the avoidance-traversing segment, and the distance value of the avoidance-traversing segment multiplied by the multiplier value.

20. The system of claim 14, wherein the normalized cost is calculated based on an amount of fuel usage value associated with the avoidance-traversing segment.

* * * * *